US011370585B2

(12) United States Patent
Shah et al.

(10) Patent No.: US 11,370,585 B2
(45) Date of Patent: Jun. 28, 2022

(54) CAP LINER

(71) Applicant: Tekni-Plex, Inc., Wayne, PA (US)

(72) Inventors: Munish Shah, Sylvania, OH (US); Palanikkumaran Muthiah, Sylvania, OH (US)

(73) Assignee: Tekni-Plex, Inc., Wayne, PA (US)

( * ) Notice: Subject to any disclaimer, the term of this patent is extended or adjusted under 35 U.S.C. 154(b) by 401 days.

(21) Appl. No.: 16/241,364

(22) Filed: Jan. 7, 2019

(65) Prior Publication Data

US 2020/0216236 A1 Jul. 9, 2020

(51) Int. Cl.
*B65D 51/16* (2006.01)
*B65D 53/04* (2006.01)

(52) U.S. Cl.
CPC ..... *B65D 51/1605* (2013.01); *B65D 53/04* (2013.01)

(58) Field of Classification Search
CPC ..... B65D 51/1605; B65D 51/1622; B65D 51/1661
USPC ..... 215/261, 347
See application file for complete search history.

(56) References Cited

U.S. PATENT DOCUMENTS 4,789,074 A 12/1988 Han
5,579,936 A 12/1996 Costa et al.
5,730,306 A * 3/1998 Costa ..... B65D 51/1616 215/261
6,378,715 B1 4/2002 Finkelstein et al.
(Continued)

FOREIGN PATENT DOCUMENTS

GB 1596472 A 8/1981
JP H10152163 6/1998
WO 199613443 A1 5/1996

OTHER PUBLICATIONS

International Search Report and Written Opinion in corresponding international application No. PCT/US2020/012117 dated Apr. 29, 2020.

(Continued)

*Primary Examiner* — Anthony D Stashick
*Assistant Examiner* — Raven Collins
(74) *Attorney, Agent, or Firm* — Polsinelli, P.C.

(57) ABSTRACT

A venting cap liner has a bottom surface facing an annular bottle lip surrounding an open top end of a bottle neck, and a top surface facing an inner top wall of a closure cap, the liner being configured to provide a gas-permeable but liquid-impervious seal that is resistant to rupture when a downwardly directed torque is applied in a thickness direction of the liner body to compression seal the liner body between the annular bottle lip and the inner top wall of the cap. In one embodiment, a two-layer liner body includes a bottom layer of a mineral-filler based polyolefin (MFP) material that is substantially liquid-impervious while allowing release of gas evolving from a liquid product in the bottle, and a top layer comprising a polyolefin (PO) foam material having a grooved upper surface with channels facing the inner top wall of the cap, and a plurality of through-holes extending in a thickness direction, wherein the layers of the liner body allow gas, evolving from a product in the sealed bottle, to permeate out the open top end of the bottle neck, through the MFP material, the through-holes of the PO foam material and along the channels to flow out of an area between an exterior surface of the bottle neck and a peripheral cap flange.

23 Claims, 8 Drawing Sheets

(56) References Cited

U.S. PATENT DOCUMENTS

| | | | | |
|---|---|---|---|---|
| 6,602,309 | B2 | 8/2003 | Vizulis et al. | |
| 6,983,857 | B2 | 1/2006 | Miller et al. | |
| 7,461,754 | B2 | 12/2008 | Walsh | |
| 7,648,764 | B2 | 1/2010 | Yousif | |
| 8,080,118 | B2 | 12/2011 | Yousif | |
| 8,220,649 | B2 * | 7/2012 | Walsh | B26F 1/24 215/307 |
| 9,708,110 | B2 | 7/2017 | Walsh | |
| 2004/0262253 | A1 * | 12/2004 | Miller | B65D 51/165 215/270 |
| 2009/0123766 | A1 * | 5/2009 | Peck | B32B 27/065 428/457 |
| 2016/0251549 | A1 * | 9/2016 | Mitchell | B32B 27/18 428/41.3 |
| 2017/0081094 | A1 | 3/2017 | Fisch | |

OTHER PUBLICATIONS

International Preliminary Report on Patentability issued in corresponding international application No. PCT/US2020/012117 dated Dec. 21, 2020.

* cited by examiner

CAP LINER

FIELD OF THE INVENTION

The present invention relates to a cap liner that provides a leak-resistant compression seal and provides for venting of gases out of a sealed bottle.

BACKGROUND OF THE INVENTION

Liners have been commonly used for sealing between a bottle having an opening and a cap securable to the bottle for enclosing the opening. A liquid-impervious seal at the bottle opening is highly desirable to preclude permeation or leakage of fluids out of the bottle. For the purposes of this application, liquid-impervious means the cap liner prevents both liquid permeation and leakage, where "permeation" means the passage of a liquid directly through the cap liner, by absorbing or adsorbing into the liner at a high concentration side, diffusion through the material of the liner in the direction of the side of lower concentration, and then desorbing from the liner on the low concentration side. The term "leakage" on the other hand, means the passage of liquid through a gap between a cap liner and a bottle.

Conventional cap liners include a material such as corrugated fiberboard, paperboard or the like, with a coating on one or both major surfaces that is resistant to liquid permeation. Such designs, although relatively inexpensive, are not sufficiently flexible, durable, structurally strong, or completely effective in precluding permeation or leakage of liquids out of a bottle. Further, corrugated fiberboard or paperboard liners generate undesirable quantities of dust or other particulates that may contaminate the contents of the bottle.

Cap liners have also been constructed of synthetic materials such as thermoplastics. Although these plastic cap liners may be more effective than cardboard cap liners against liquid permeation or leakage, they inherently require more expensive materials and manufacturing techniques. For example, Performance Systematix Inc. (PSI) (e.g., U.S. Pat. No. 6,602,309) discloses a venting liner but requires a complicated structural arrangement and modifications to the cap, for example, providing a single large diameter vent hole in a layer of PE foam that is covered by a "PTFE (polytetrafluoroethylene) patch", and the cap requires a hole and ridges to vent the gas. If the bottle has a dual chamber then the vent patch of the PSI liner can align itself to the bottle center lip (i.e., the land dividing the bottle into two chambers) or can align with one of the two chambers causing inefficient venting. PSI also includes a metal foil barrier layer and a meltable induction heat seal layer bonded to one side of the foam. DeWal (e.g., U.S. Pat. Nos. 9,708,110, 8,220,649 and 7,461,754) also discloses various venting liner structures utilizing PTFE, for example having an outer layer of PE foam that is perforated and has grooves on one side and a full inner layer of PTFE on the non-grooved side; however the liner has been found to rupture (resulting in product leakage) when subjected to an application torque for sealing the liner between the cap and container opening.

Thus, there is a need for improved venting liners that avoid the problems of the prior art liners.

SUMMARY OF THE INVENTION

A cap liner is provided forming a gas-permeable, but liquid-impervious compression seal between a cap and bottle opening while allowing venting of gases that evolve from a product within the sealed bottle.

In one embodiment of the invention, a cap liner is provided comprising:

a disc-shaped venting cap liner body having a bottom surface facing an annular bottle lip surrounding an open top end of a bottle neck, and a top surface facing an inner top wall of a closure cap, the body being configured to provide a gas-permeable but liquid-impervious seal that is resistant to rupture when a downwardly directed application torque is applied in a thickness direction of the liner body to compression seal the liner body between the annular bottle lip and the inner top wall of the cap to form a sealed bottle, the cap liner body including top and bottom layers wherein:

(a) the bottom layer comprises a mineral-filler based polyolefin (MFP) material having a lower surface configured to compression seal to the annular bottle lip and an upper surface bonded to a non-grooved lower surface of the top layer, wherein the MFP material layer is substantially liquid-impervious while allowing release of gas evolving from a liquid product in the sealed bottle; and (b) the top layer comprises a polyolefin (PO) foam material having a grooved upper surface with channels facing the inner top wall of the cap, and a plurality of through-holes extending in a thickness direction of the PO foam material between the grooved upper and non-grooved lower surfaces of the top layer to allow gas, evolving from a product in the sealed bottle, to permeate out the open top end of the bottle neck, through the MFP material and the through-holes of the PO foam material, and along the channels in the grooved upper surface of the top layer, allowing the gas to then flow out of a peripheral area disposed between an outer surface of the bottle neck and a peripheral cap flange extending downwardly from the inner top wall of the cap.

In one embodiment, the cap liner body is configured to withstand rupture when applied to an annular bottle lip having an outer diameter OD of from 15 mm to 120 mm at an application torque in a range of 5 to 75 inch-pounds (in-lbs) as provided according to Technical Bulletin SPI/PBI 20-1982.

In one embodiment, the outer diameter OD and associated application torque range are selected from the group consisting of (OD; torque):

24 mm; 10 to 18 in-lbs;
28 mm; 12 to 20 in-lbs;
33 mm; 14 to 26 in-lbs;
38 mm; 16 to 28 in-lbs;
45 mm; 18 to 30 in-lbs; and
53 mm; 22 to 36 in-lbs.

In one embodiment: the bottom layer has a thickness in a range of 0.0005 to 0.005 inch (12.5 to 125 micron); the top layer has a thickness in a range of 0.020 to 0.100 inch (0.51 to 2.54 mm); and the outer diameter is in a range of 15 to 120 mm.

In one embodiment, the surface area of the bottom surface of the disc-shaped liner is from 177 to 11,304 mm-squared (0.274 to 17.5 inch-squared).

In one embodiment, the channels are substantially uniformly distributed across the top surface and extend partially or fully across the top surface.

In one embodiment, the channels have a width in a range of 0.020 to 0.200 inch (0.51 to 5.1 mm) and a depth in a range of 0.0025 to 0.050 inch (0.064 to 1.27 mm).

In one embodiment, the through-holes are substantially uniformly distributed across the grooved upper surface.

In one embodiment, the through-holes are substantially cylindrical and have a diameter transverse to the thickness direction in a range of 0.4 to 1.4 mm.

In one embodiment, the diameter of the through-holes is from 0.4-0.8 mm.

In one embodiment, the diameter of the through-holes is from 0.5-0.6 mm.

In one embodiment, the top layer includes a non-foam skin covering one or both of the upper and lower surfaces of the PO foam material, the non-foam skin being of a material that is the same or different than the PO foam material.

In one embodiment, the MFP material comprises:

one or more polymers comprising polyethylene (PE) and polypropylene (PP), including copolymers and blends thereof, and one or more mineral fillers comprising a carbonate, oxide, silica, silicate, clay and sulfate.

In one embodiment, the mineral fillers are one or more of CaCo3, TiO2, talc, kaolin, and CaSO4.

In one embodiment, the one or more polymers comprise 30 to 70 percent of the total weight of the MFP material, and the one or more mineral fillers comprise 30 to 70 percent of the total weight of the MFP material.

In one embodiment, the PO foam material comprises polyethylene (PE).

In one embodiment, a further MFP material layer lies on the grooved upper surface of the foam layer and into the channels, to form the grooved upper surface of the top layer.

In one embodiment, the liner body is provided in combination with, (a) a bottle having an annular bottle lip surrounding an open top end of a bottle neck;

(b) a removable closure cap having an inner top wall and a peripheral cap flange extending downwardly from the inner top wall that is secured to the bottle neck for enclosing the open top end; and (c) the cap liner body being mounted on the cap and disposed between the annular bottle lip and the inner top wall of the cap, the cap liner body providing a liquid impervious seal that is resistant to rupture when a downwardly directed application torque is applied in a thickness direction of the liner body to compression seal the liner body between the annular bottle lip and the inner top wall of the cap.

In accordance with another embodiment of the invention, a three-layer cap liner is provided comprising:

a disc-shaped venting cap liner body having a bottom surface facing an annular bottle lip surrounding an open top end of a bottle neck, and a grooved top surface facing an inner top wall of a closure cap, the body being configured to provide a gas-permeable but liquid-impervious seal that is resistant to rupture when a downwardly directed application torque is applied in a thickness direction of the liner body to compression seal the liner body between the annular bottle lip and the inner top wall of the cap to form a sealed bottle, the cap liner body including top and bottom layers and a central layer between the top and bottom layers wherein:

(a) the bottom layer comprises a mineral-filler based polyolefin (MFP) material having a lower surface configured to compression seal to the annular bottle lip and an upper surface bonded to a non-grooved lower surface of the central layer, wherein the MFP material layer is substantially liquid-impervious while allowing release of gas evolving from a liquid product in the sealed bottle; and (b) the central layer comprises a compressible polymer material having a grooved upper surface with channels facing toward the inner top wall of the cap, and a plurality of through-holes extending in a thickness direction of the material between the grooved upper and non-grooved lower surfaces of the central layer;

(c) the top layer being configured to lie on the grooved upper surface of the central layer and into the channels facing the inner top wall of the cap, the top layer comprising a mineral-filler based polyolefin (MFP) material that is substantially liquid-impervious while allowing release of gas evolving from a liquid product in the sealed bottle, wherein the layers of the liner body allow gas, evolving from a product in the sealed bottle, to permeate out the open top end of the bottle neck, through the top and bottom layers of MFP material and the through-holes of the central layer, and along the channels facing the inner top wall of the cap, allowing the gas to then flow out of a peripheral area disposed between an outer surface of the bottle neck and a peripheral cap flange extending downwardly from the inner top wall of the cap.

In one embodiment, the compressible polymer material of the central layer comprises one or more of a foam polymer material and a solid polymer material.

In one embodiment, the compressible polymer material of the central layer comprises a foam polymer material comprising one or more of polyolefin and vinyl acetate polymer materials.

In one embodiment, the polyolefin includes one or more of polyethylene and polypropylene.

In one embodiment, the compressible polymer material of the central layer comprises a solid polymer material having a Shore A hardness in a range of 40 to 80 and comprising one or more thermoplastic elastomers and ethylene alfa-olefin resin polymers.

BRIEF DESCRIPTION OF THE DRAWINGS

The above and further advantages of various embodiments of the invention may be better understood by referring to the following description in conjunction with the accompanying drawings in which.

DETAILED DESCRIPTION OF THE INVENTION

FIGS. 1-8 illustrate a two-layer liner embodiment of the present invention, showing the layer structures, dimensions and use in providing a compression seal between an annular lip surrounding an open top end of a bottle neck, and an inner top wall of a closure cap.

FIGS. 9-14 illustrate a three-layer liner embodiment of the present invention, showing the layer structures, dimensions and use in providing a compression seal between an annular lip surrounding an open top end of a bottle neck, and an inner top wall of a closure cap.

Figure 15:
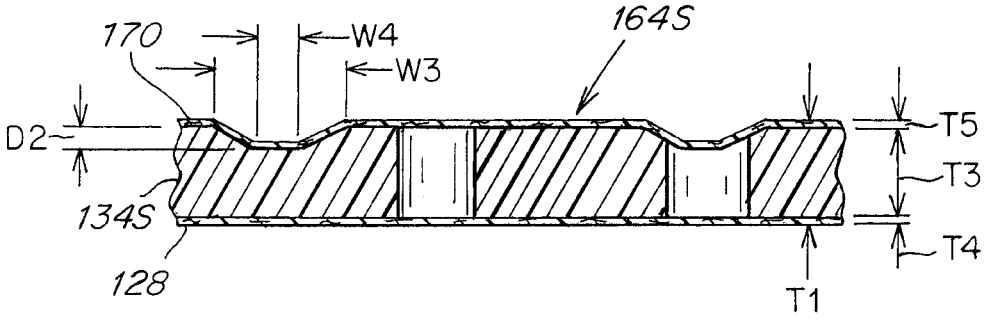
FIG. 15 is a cross-sectional view of an alternative three-layer liner body with a central layer of a solid compressible polymer material.

FIG. 15 illustrates an alternative three-layer liner embodiment.

Two-Layer Liner Embodiment of FIGS. 1-8

Figure 1:
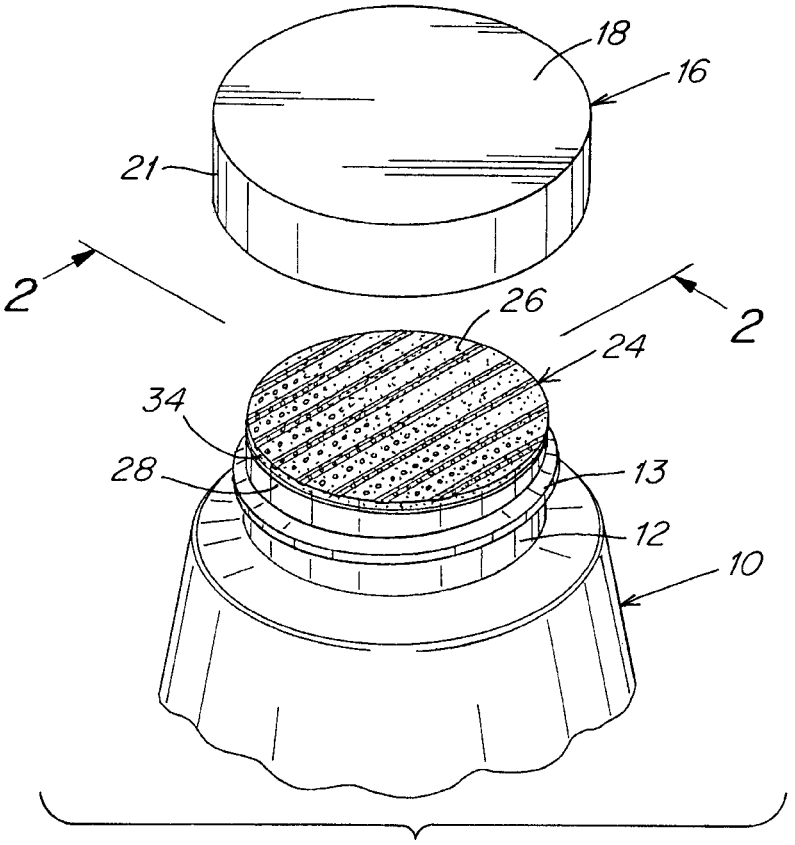
FIG. 1 is an exploded perspective view of a two-layer venting cap liner having top and bottom layers according to one embodiment of this invention, the liner being positioned between an annular bottle lip surrounding an open top end of a bottle neck, and an inner top wall of a cap.
Figure 2:
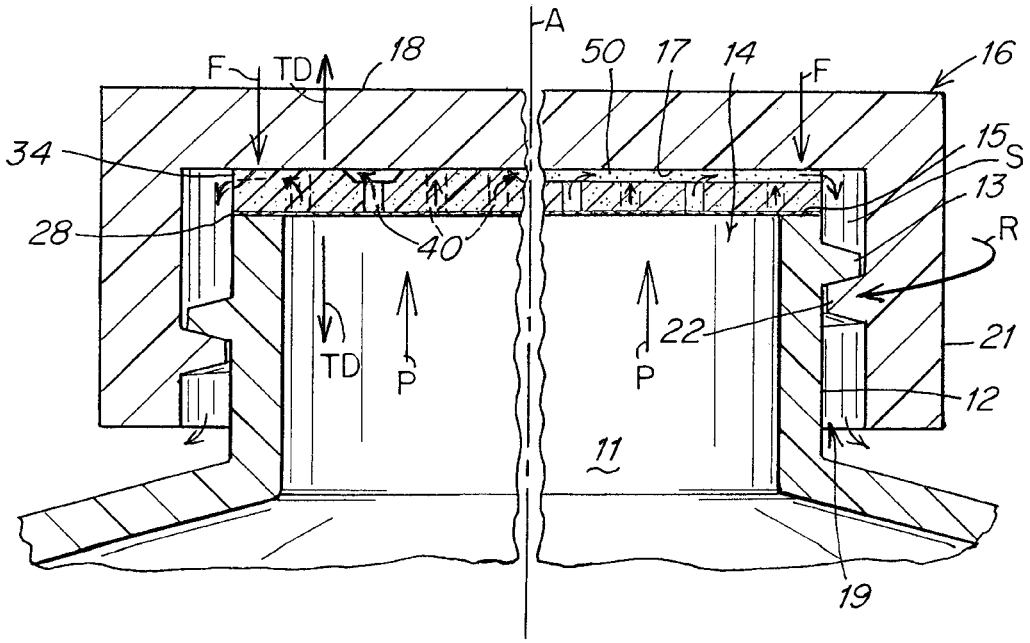
FIG. 2 is a cross-sectional side view taken along line 2-2 of FIG. 1, with the liner now compression sealed in a thickness direction (TD) between the inner top wall of the cap and the annular bottle lip, showing the path of escape of internal gas pressure from the sealed bottle.
Figure 3:
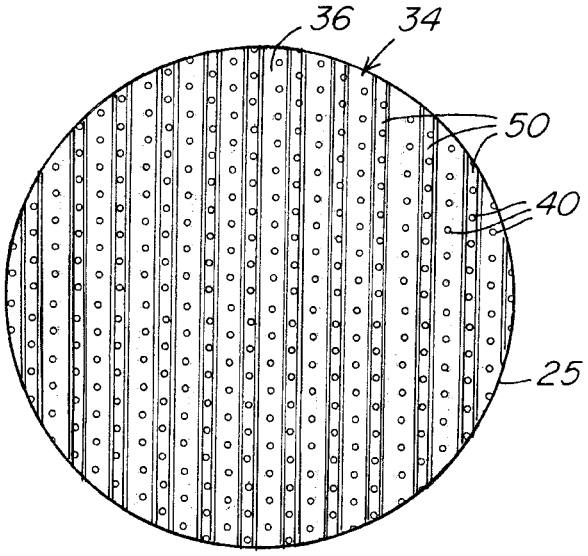
FIG. 3 is a top plan view of the top layer of the liner of FIG. 1, the top layer being made of polyolefin (PO) foam material having a plurality of through-holes extending through the thickness direction and a grooved upper surface having channels extending transverse to the thickness direction.
Figure 8:
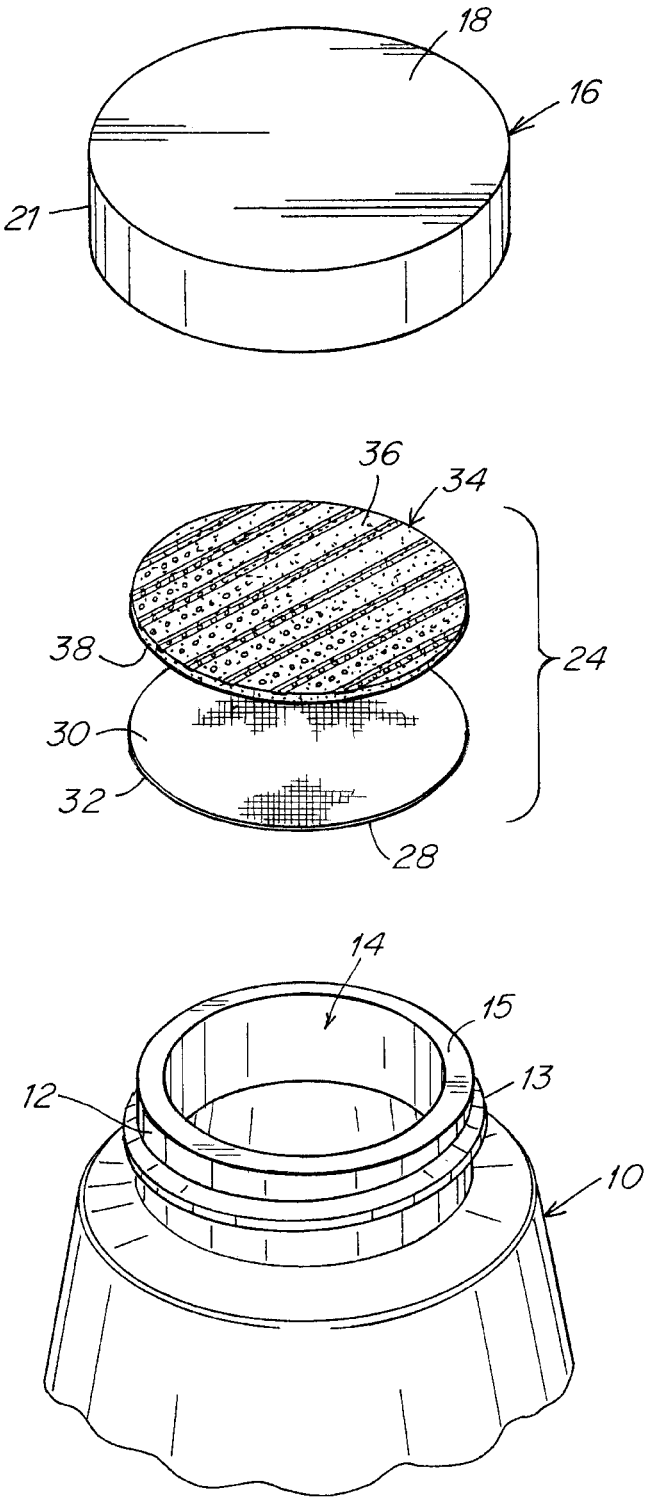
FIG. 8 is an exploded perspective view of the liner, cap and bottle neck of FIG. 1, showing the top and bottom liner layers spaced vertically apart but aligned one above the other in the thickness direction (aligned with a central cylindrical bottle axis A that is common with a cylindrical axis of the disc-shaped liner layers), before the top and bottom liner layers are bonded together along at least a portion of their facing surfaces.
Figure 9:
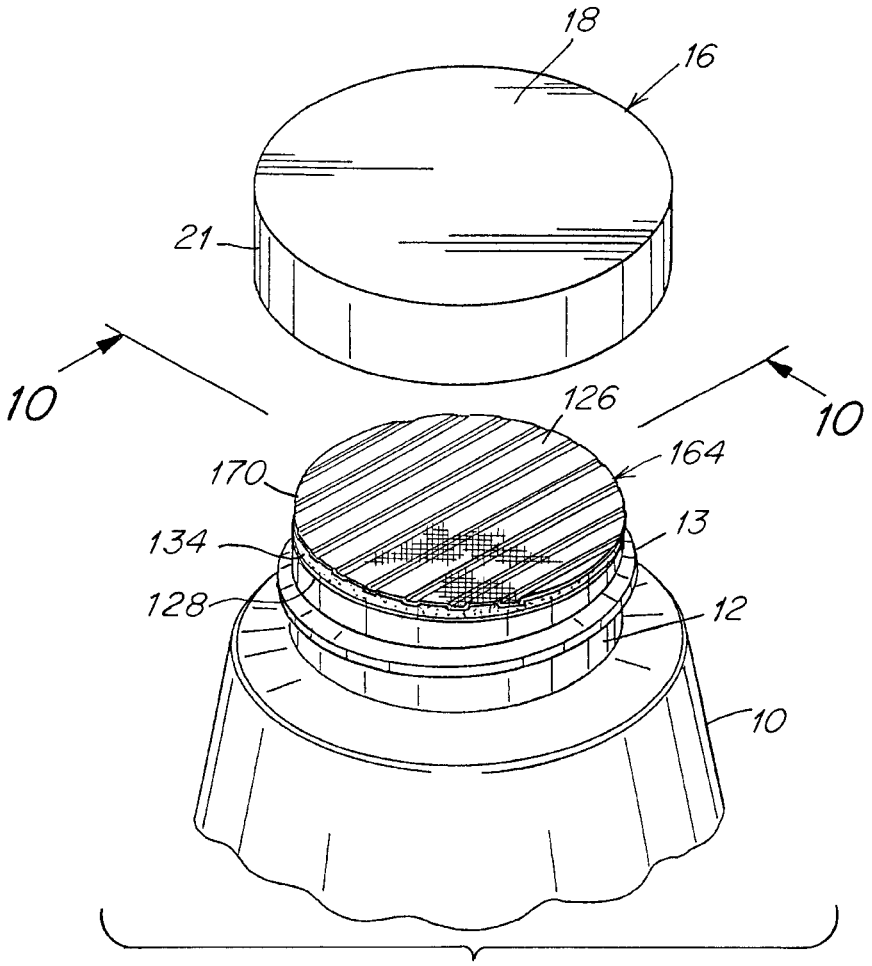
FIG. 9 is an expanded perspective view of an alternative three-layer embodiment of a venting cap liner embodiment of this invention, positioned between an annular bottle lip and an inner top wall of the cap similar to the FIG. 1 view, this liner embodiment having an additional third layer bonded over the top layer of the first embodiment.
Figure 10:
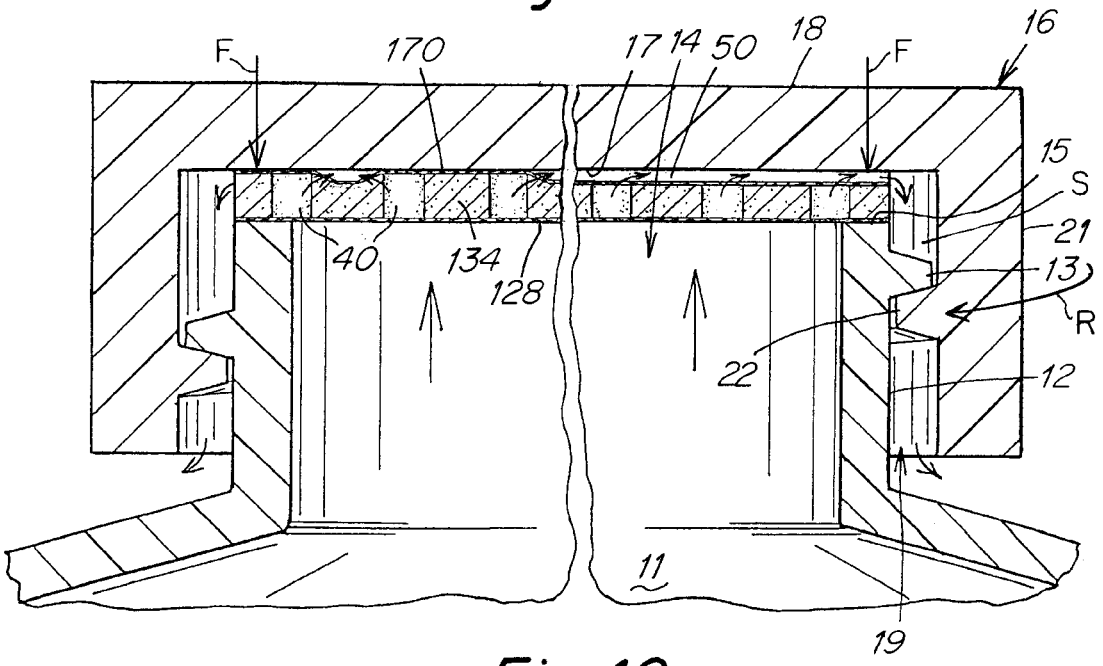
FIG. 10 is a cross-sectional side view taken along line 10-10 of FIG. 9.
Figure 11:
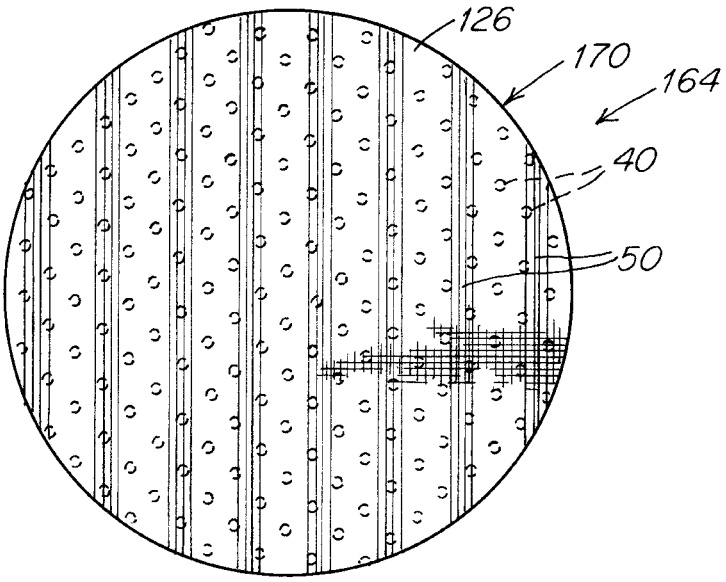
FIG. 11 is a top plan view of the liner of FIG. 9.
Figure 12:
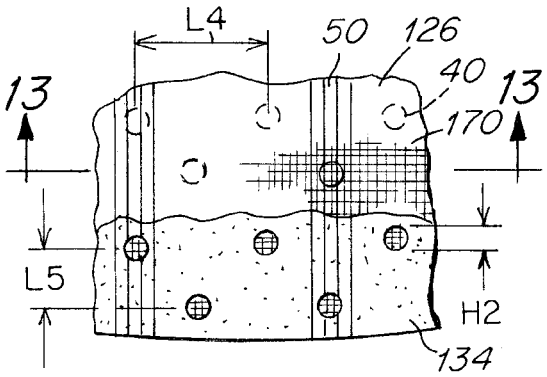
FIG. 12 is an enlarged fragmentary view of the liner of FIG. 9 showing representative through-hole size and placement.
Figure 13:
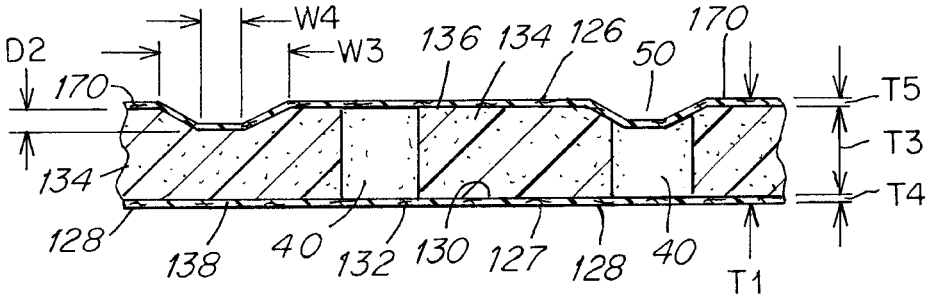
FIG. 13 is a cross-sectional view taken along line 13-13 of FIG. 12 showing details of the channels in the grooved top surfaces of the top and central layers.
Figure 14:
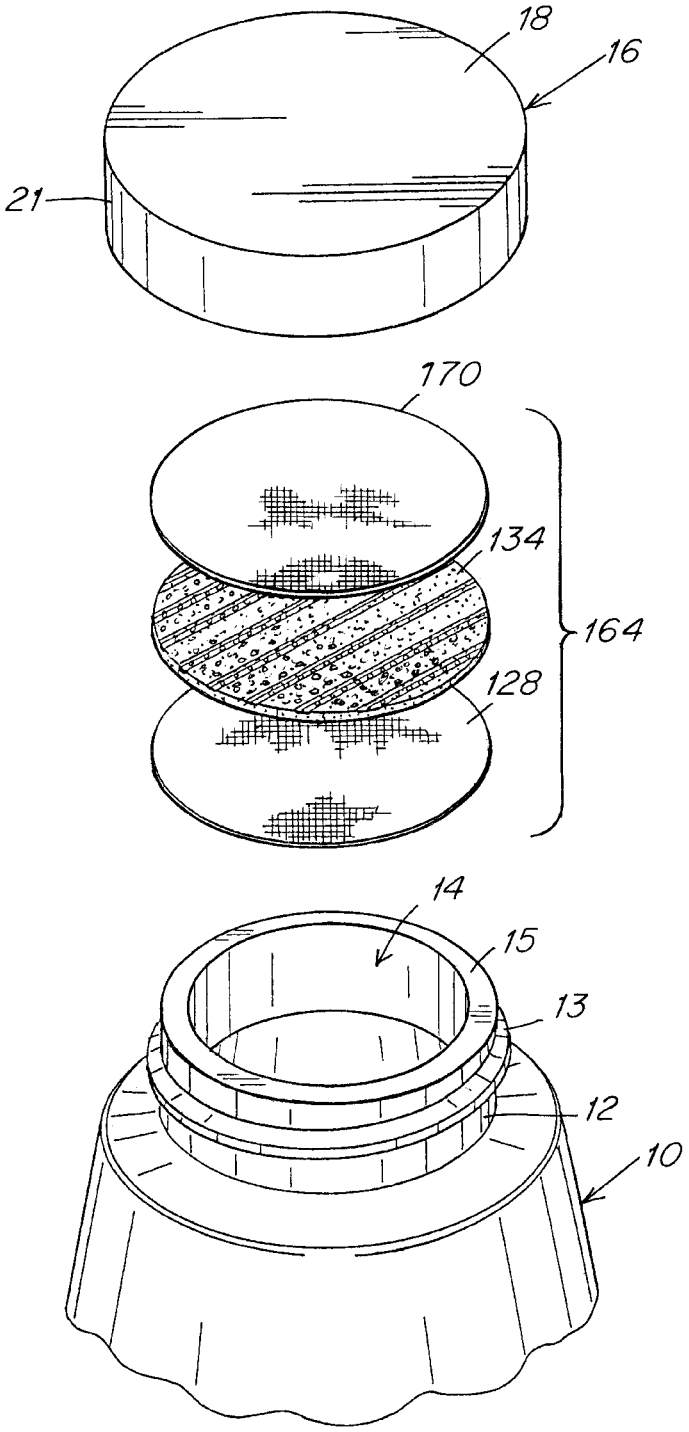
FIG. 14 is an exploded perspective view of the three-layer liner assembly of FIG. 9.

Referring now to the first embodiment, FIGS. 1 and 8 show an upper end of a bottle 10 having neck 12 and opening 14 communicating through neck 12 to the interior 11 of the bottle. Cap 16 is provided to enclose opening 14 and is securable to the bottle by threads 13 on neck 12 of the bottle engaging cooperative threads 22 on a peripheral flange 21 of the cap (as shown in FIG. 2).

FIG. 1 shows a two-layer disc-shaped cap liner body 24 disposed between the cap and bottle for sealing the bottle opening 14, and more specifically being compressions sealed against annular lip 15 (which surrounds the opening 14). The construction of cap liner 24 is shown in greater detail in FIGS. 2-8 and includes a bottom layer 28 comprising a gas-permeable, but liquid-impervious mineral-filler based polyolefin (MFP) material layer having opposing disc-shaped upper and lower major surfaces 30 and 32 defined with respect to a central cylindrical axis A. The cap liner 24 also includes a top layer 34 comprising a polyolefin (PO) foam material layer having opposing disc-shaped upper and lower major surfaces 36 and 38. The lower surface 38 of the top PO foam layer is bonded (e.g., laminated) to the upper surface 30 of the bottom MFP layer 28. Optionally, one or more of the adjacent surfaces 38, 30 may be treated prior to lamination such by a corona treatment or by various chemical processes to enhance the bonding of the PO foam top layer 34 and the MFP bottom layer 28.

The bottom MFP layer 28 is preferably constructed of a polyolefin (e.g., polyethylene) based polymer material that includes a mineral filler, here an inorganic mineral powder (e.g., calcium carbonate CaCO3) mixed therein to form a microporous (gas-permeable, but liquid-impervious) composite material. The composite material should be chemically inert in regard to the intended contents of the bottle 10, while providing sufficient elasticity and substantial liquid impermeability for effective compression sealing within a desired temperature range to which the bottle and its contents are to be exposed during use or storage. Further, the MFP layer must be able to withstand an application torque, as described further below, without rupture. Suitable polyolefin polymers for making the MFP layer include low and medium density polyethylene (PE) and polypropylene (PP), including copolymers and blends thereof. Suitable mineral fillers include a carbonate, oxide, silica, silicate, clay and sulfate, such as (for example) CaCo3, TiO2, talc, kaolin, and CaSO4. Preferably, the MFP material includes one or more polyolefin polymers in a range of 30 to 70 percent of the total weight of the MFP material, and the one or more mineral fillers in a range of 30 to 70 percent of the total weight of the MFP material. Preferably an MFP material is selected having a density in a range of 0.25-1.4 g/cc. The composition of the MFP composite material, the layer thickness, and the surface area can be selected based on the particular application, including the desired application (or removal) torque and the size of the open top end of the bottle, as discussed further below.

Although the MFP layer 28 may be constructed of a single layer of material, it is within the scope of this invention to provide one or more additional layers of materials in the MFP layer so long as the liquid-impervious and gas-permeability properties are provided.

The top PO foam layer 34 is constructed of a resilient, compressible, thermoplastic material. In the present embodiment, the foam layer 34 is constructed of a closed cell, foamed polyethylene (PE) based polymer material, such as by introducing a blowing agent prior to extrusion of the polymer melt. Suitable blowing agents include physical foaming agents such as $N_2$ gas and $CO_2$ gas, and chemical foaming agents such as exothermic agents (e.g., azodicarbonamide) and endothermic agents (e.g., sodium bicarbonate citric acid, or trisodiumcitrate). A foam layer is produced with a reduced density for a given thickness compared to unfoamed materials, while enhancing the resiliency and compressibility of the foam layer thus constructed. Preferably the foam has a density in a range of 16 lbs./feet$^3$ to 36 lbs./feet$^3$ (250 kg/meter$^3$-580 kg/meter$^3$) and a hardness in a range of 55 to 90 on the Shore A scale. Thermoplastic materials are available with desired properties for constructing the foam layer 34 including low density polyethylene and polypropylene, and copolymers and blends thereof. In one embodiment, the top PO foam layer comprises a central PE foam layer having opposing top and bottom skins of solid (non-foam) PE film, such as Tri-Seal BLV F-219 available from Tri-Seal Company, Blauvelt N.Y., USA.

PO foam layer 34 is constructed in sheet form with opposing upper and lower major surfaces 36, 38 and includes a plurality of spaced openings 40 (through-holes) extending through the sheet thickness in the direction of axis A. The openings extend either between the opposing major surfaces 36, 38 or between the lower surface 38 and a channel 50 in the upper surface 36 as described below. The openings 40 provide gas-permeability and their size, number and spacing may be tailored to provide a desired rate of gas flow out of the bottle. The openings produce a foam layer with lower overall density than conventional cap liners without adversely affecting strength, compressibility or resiliency, particularly in a thickness direction (TD) perpendicular to the first and second major surfaces 36, 38 of the foam layer (in the direction of the cylindrical bottle axis A).

Figure 4:
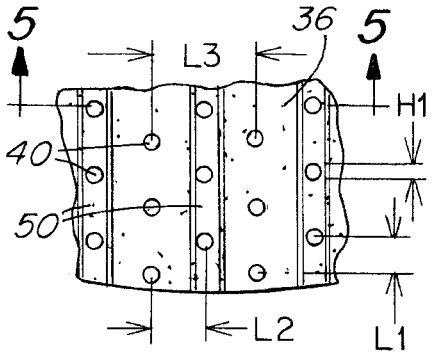
FIG. 4 is an enlarged fragmentary view of the top layer of FIG. 3 showing a representative size and placement of the through-holes.
Figure 5:
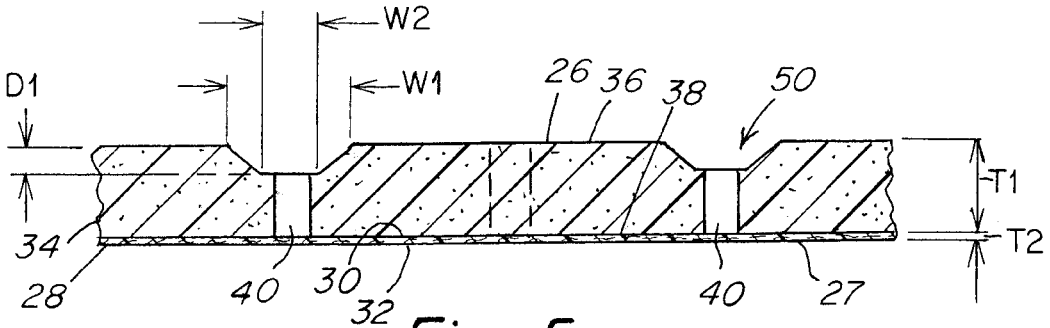
FIG. 5 is a cross-sectional side view taken along line 5-5 FIG. 4 showing details of the channels in the grooved upper surface of the PO foam layer, and the relative thicknesses of the top and bottom layers.
Figure 6:
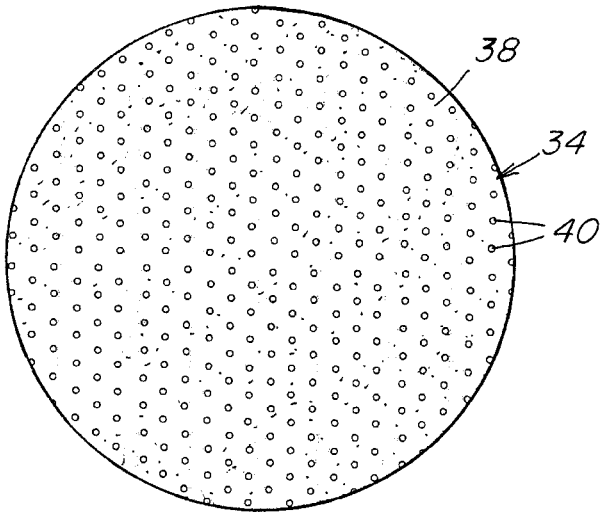
FIG. 6 is a bottom plan view of the non-grooved lower surface of the PO foam layer of FIG. 3 by itself (shown without the bottom layer present).
Figure 7:
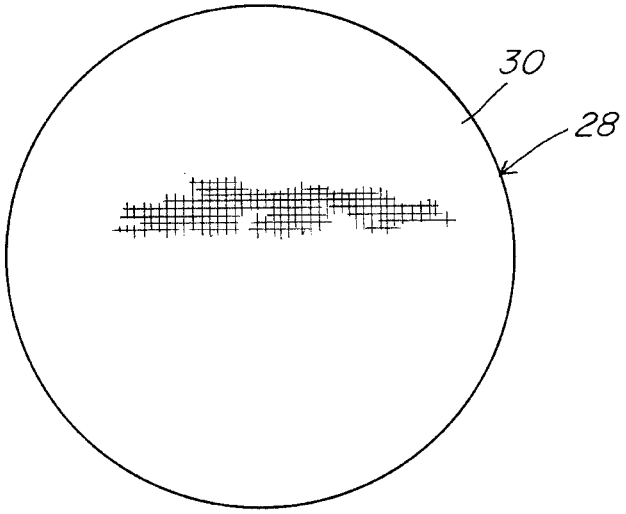
FIG. 7 is a top plan view of the bottom layer of the liner of FIG. 1, made of a mineral-filler based polyolefin (MFP) material, shown without the top layer present (the bottom view being identical).

The openings 40 may be uniformly distributed across the surface area of the top layer; alternatively they are randomly and non-uniformly distributed. In the embodiment of FIGS. 1-8, the holes 40 are of uniform size and are uniformly distributed across the surface area of the top layer 34. As shown in FIGS. 4-5, the through-holes 40 in the present embodiment are: uniformly distributed; have a circular cylindrical cross section of diameter H1; are spaced apart a distance L1 in a first direction in the plane of the sheet, and are spaced apart a distance L2 in a second transverse direction also in the plane of the sheet. A lightweight, strong foam layer 34 is produced that is compressible and resilient in a direction perpendicular to the upper and lower major surfaces 36, 38 of the top foam layer 34. The relative sizes of H1, L1 and L2 can be varied based on the selected liner materials, surface areas and thicknesses, as well as the intended use applications (e.g., the type of liquid product held in the sealed bottle, application torque, desired rate of venting of the internal gas pressure, and expected maximum internal gas pressure in the sealed bottle).

The upper surface 36 of the top foam layer 34 includes a plurality of grooved channels 50, that extend between at least one or more of the through-holes 40 and the outer edge 25 (circumference) of the disc-shaped layer 34 (and liner 24) so as to allow gas in the sealed bottle (presumably produced by the product in the bottle) to escape, i.e., travel upwardly (in the thickness direction TD, aligned with the bottle axis A) through the thickness T2 of the bottom MFP layer 28, through the holes 40 in the upper foam layer 34 (the holes extending the entire thickness T1 of layer 34 and/or extending from the lower surface 38 up and to and intersecting with a channel 50 in the upper surface 36), and then travel in a direction B in the plane of the foam layer 34 (transverse to axis A) along the channels 50 to the circumferential edge 25 of the liner 24, and then downwardly (along the thickness direction A) though a space S (see FIG. 2) between the exterior surface of bottle neck 12 and threads 13 (that surround the bottle opening 14), and an interior surface 23 of a downwardly-extending peripheral flange 21 of the cap, and finally out the open bottom end 19 of the cap into the surrounding atmosphere.

As best shown in FIG. 5, the grooved channels 50 in the upper surface 36 of the top foam layer 34 (same as upper liner surface 26) are a plurality of trapezoidal shaped channels 50 laid out parallel to one another, and extending downwardly (in direction TD) a distance D1 from the upper surface 36 of the foam layer. In this embodiment, the trapezoidal channel 50 has a greater width at the top end of W1, and a smaller width at the bottom end of W2, with a pair of opposite slanted sidewalls therebetween. The particular dimensions of the channels, and relative spacing and length, can be selected based on a particular use and liner materials, thicknesses, and hole dimensions and distribution.

Referring now to FIG. 2, the cap liner 24 is cut in a size and shape for mounting against an inner surface 17 of the top wall 18 of cap 16, with the upper liner surface 26 (here the upper surface 36 of top layer 34) presented adjacent surface 17. In one embodiment, the disc-shaped liner can be retained by a cap thread or a retention bead on an interior sidewall of the cap. Optionally, the upper liner surface 26/36 is partially secured to interior cap surface 17 by adhesive.

In operation, cap 16 is secured to the bottle by threads 22 on the inside of the cap flange 21 engaging (being screwed onto) cooperative threads 13 of the bottle neck, as shown in FIG. 2. In a cap secured to a bottle by cooperative threads, a minimum "application torque" must be applied in tightening the cap to ensure an effective seal against leakage. The cap 16 is rotatably R and downwardly F (see arrows R and F in FIG. 2) applied/tightened to the bottle neck with a desired application torque (e.g., 2.8 joules (25 in-lbs.) for a 38 mm bottle). In doing so, the lower liner surface 27 (i.e., the lower surface 32 of the bottom layer 28) is placed adjacent to and in contact with the annular bottle lip 26 of the bottle. Further, liner 24 is concentrically compressed between lip 26 and inner surface 17 of the top wall of the cap in direction A perpendicular to first and second major liner surfaces 26/36 and 27/32. The compressed liner acts to resiliently urge the lower surface 32 of bottom layer 28 into sealing contact with the bottle lip 26 circumferentially about opening 14 and thus simultaneously seals the bottle against both liquid permeation through the cap liner and leakage between the cap liner and the bottle.

To detach cap 16, a release torque (upwardly rotatable force) is applied to the cap. The release torque may be greater than the application torque, due to the generally greater compressibility and resiliency of foamed materials. However, the cap liner should be constructed so that the release torque is not so great that the cap may not be conveniently manually removed from the bottle. By way of example, the release torque is preferably less than 7.3 joules (65 in-lbs.) for a 38 mm (1.50") diameter bottle having an application torque of 2.8 joules (25 in-lbs.). Once the cap 16 has been removed from the bottle, the liner 24 resiliently returns to substantially its undeformed shape for subsequent reuse (i.e., reapplying/rethreading the cap to the bottle neck).

In most applications, the top foam layer 34 will be substantially thicker than the bottom MFP layer 28. For instance, a top foam layer 34 having a thickness T1 of 0.10 cm (0.040 inch) may be bonded to a bottom MFP layer 28 having a thickness T2 of 0.01 cm (0.004 inch) to 0.11 cm (0.0045 inch). Preferably, the foam layer 34 is coextensive with the first major (top) surface 30 of the bottom MFP layer 28. In the present embodiment, the top and bottom layers are both disc-shaped and have the same diameter.

In one embodiment, the top foam layer 34 is Tri-Seal BLV F-219 (available form Tri-Seal Company, Blauvelt, N.Y.) with a three layer structure of: LDPE skin/LDPE foam/LDPE skin, a target thickness T1 of 0.040 inch, and 23 lbs./ft. cube (370 kg/meter$^3$) density. The holes 40 in top layer 34 have a circular diameter of 0.55 mm. The bottom layer 28 is a PE/CaCO3 material (e.g., 50 weight percent PE and 50 weight percent CaCO3 based on the total weight of material) with a thickness T1 of 0.040 inch. The upper surface 10 of the bottom layer 28 is bonded by heat and pressure lamination to the lower surface 38 of the top layer 34.

The relative layer thicknesses T1:T2 of the top and bottom layers 34, 28 respectively may be tailored to a particular application; they are generally in a range of (T1=0.020-0.100 inch):(T2=0.0005 0.005 inch), more specifically (T1=0.030-0.050 inch):(T2=0.001-0.002 inch), and further more specifically (T1=0.040 inch):(T2=0.0016 inch). In various embodiments: the bottom layer 28 has a thickness T2 in a range of 0.0005 to 0.005 inch (12.5 to 125 micron); the top layer 34 has a thickness T1 in a range of 0.020 to 0.100 inch (0.51 to 2.54 mm); and the outer diameter of the liner is in a range of 15 to 120 mm. Preferably, the outer diameter of the disc-shaped liner 24 substantially matches the outer diameter of the annular lip 15 surrounding the bottle opening 14. In various embodiments, the surface area of the bottom surface of the disc-shaped liner is from 177 to 11,304 mm-squared (0.274 to 17.5 inch-squared). In various embodiments, the outer diameter OD (of the liner 24 and bottle lip 15) and associated application torque range (according to Technical Bulletin SPI/PBI 10-1982, for closure application by hand) are selected from the group consisting of (OD; torque):

24 mm; 10 to 18 in-lbs;
28 mm; 12 to 20 in-lbs;
33 mm; 14 to 26 in-lbs;
38 mm; 16 to 28 in-lbs;
45 mm; 18 to 30 in-lbs;
53 mm; 22 to 36 in-lbs.

Three-Layer Liner Embodiments of FIGS. 9-14 and 15

FIGS. 9-14 and 15 illustrate alternate embodiments of a three-layer cap liner construction, including top and bottom layers of MFP material, and a central layer of a compressible material. This embodiment provides further protection against liquid leakage. For example, if the bottom MFP layer contacting the annular bottle lip 15 distorts or ruptures (e.g., due to a high closure application toque to the bottle lip, or a nick/burr or parting line mismatch or deformity with the bottle lip), then the top MFP layer will provide leak protection.

The three-layer cap liner embodiment shown in FIGS. 9-14 comprises:

a disc-shaped venting cap liner body 164 having a bottom surface 127 facing an annular bottle lip 15 surrounding an open top end of a bottle neck 12, and a grooved top surface 126 facing an inner top wall 17 of a closure cap 16, the body being configured to provide a gas-permeable but liquid-impervious seal that is resistant to rupture when a downwardly directed application torque is applied in a thickness direction of the liner body to compression seal the liner body between the annular bottle lip and the inner top wall of the cap to form a sealed bottle, the cap liner body including top and bottom layers 170 and 128 respectively and a central layer 134 between the top and bottom layers wherein:

(a) the bottom layer 128 comprises a mineral-filler based polyolefin (MFP) material having a lower surface 132 configured to compression seal to the annular bottle lip 15 and an upper surface 130 bonded to a non-grooved lower surface 138 of the central layer 134, wherein the MFP material layer is substantially liquid-impervious while allowing release of gas evolving from a liquid product in the sealed bottle; and (b) the central layer 134 comprises a compressible polymer material having a grooved upper surface 136 with channels 50 facing toward the inner top wall 17 of the cap, and a plurality of through-holes 40 extending in a thickness direction of the compressible polymer material between the grooved upper 136 and non-grooved lower 138 surfaces of the central layer;

(c) the top layer 170 being configured to lie on the grooved upper surface 136 of the central layer and into the channels 50 to form the grooved top surface 126 of the cap liner body facing the inner top wall of the cap, the top layer 170 comprising a mineral-filler based polyolefin (MFP) material that is substantially liquid-impervious while allowing release of gas evolving from a liquid product in the sealed bottle;

wherein the layers 170, 134, 128 of the cap liner body allow gas, evolving from a product in the sealed bottle, to permeate out the open top end 14 of the bottle neck 12, through the top and bottom layers of MFP material 170, 128 and the through-holes 40 of the central layer 134, and along the channels 50 facing the inner top wall 17 of the cap, allowing the gas to then flow out of a peripheral area disposed between an outer surface of the bottle neck 12 and a peripheral cap flange 21 extending downwardly from the inner top wall of the cap.

The compressible polymer material of the central layer 134 comprises one or more of a foam polymer material and a solid polymer material. FIGS. 11-14 show a central layer of a foam material, such as one or more of polyolefin and vinyl acetate polymer materials (e.g., including one or more of polyethylene, polypropylene, and ethylene vinyl acetate (EVA)). FIG. 15 shows a central layer 134S of a solid (non-foam) polymer material. The solid polymer material may have a Shore A hardness in a range of 40 to 80 and comprise one or more of thermoplastic elastomers and ethylene alfa-olefin resin polymers.

In one or more embodiments (e.g., FIGS. 1-14), the foam layer 34, 134 could be made of any polyolefin (PO) material such as polyethylene (PE), polypropylene (PP), and copolymers or blends of PE and PP. Alternatively, or in addition the, foam can be a vinyl acetate polymer material such as ethylene vinyl acetate (EVA). The foam can have a skin layer on one or both opposing surfaces of the central foam layer of the same material as the foam, or the skin layer can be of a different material. The central foam layer can be without a skin layer, e.g., expanded polyethylene foam (EPE) that is without a skin (i.e. no skin on either side).

In another embodiment, the three-layer liner 164S shown in FIG. 15 has a central compressible layer 134S which is a solid (non-foam) compressible layer. This compressible solid layer may have a Shore A scale hardness in a range of from 40 to 80, and comprised of materials such as thermoplastic elastomers (e.g. ethylene propylene rubber, PP/EPDM (ethylene propylene diene monomer) rubber, poly isobutylene, styrene ethylene/1-butene styrene (SEBS), styrene butadiene styrene (SBS)) or ethylene alfa-olefin resins (e.g. grades of Dow resins versify, infuse, engage).

Based on the intended application, the cap liner may provide venting in both directions, both into and out of the bottle, based on the driving force of the pressure. For example, if a product (such as antioxidant type vitamin) absorbs gas from the head space of the sealed bottle, and the bottle side wall (which is typically lower in strength than the bottom or neck) collapses, then gas from the environment can be driven into the sealed bottle through the liner.

The cap liner of the present invention is particularly well suited for venting pressure out of the sealed bottle, e.g., for products, such as hypochlorite—bleach, hydrogen peroxide, that release gas and build up pressure inside the package.

What is claimed is:

1. A cap liner comprising:

a disc-shaped venting cap liner body having a bottom surface facing an annular bottle lip surrounding an open top end of a bottle neck, and a top surface facing an inner top wall of a closure cap, the body being configured to provide a gas-permeable but liquid-impervious seal that is resistant to rupture when a downwardly directed application torque is applied in a thickness direction of the liner body to compression seal the liner body between the annular bottle lip and the inner top wall of the cap to form a sealed bottle, the cap liner body including top and bottom layers wherein:

(a) the bottom layer comprises a mineral-filler based polyolefin (MFP) material having a lower surface configured to compression seal to the annular bottle lip and an upper surface bonded to a non-grooved lower surface of the top layer, wherein the MFP material layer is substantially liquid-impervious while allowing release of gas evolving from a liquid product in the sealed bottle; and (b) the top layer comprises a polyolefin (PO) foam material having a grooved upper surface with channels facing the inner top wall of the cap, and a plurality of through-holes extending in a thickness direction of the PO foam material between the grooved upper and non-grooved lower surfaces of the top layer to allow gas, evolving from a product in the sealed bottle, to permeate out the open top end of the bottle neck, through the MFP material and the through-holes of the PO foam material, and along the channels in the grooved upper surface of the top layer, allowing the gas to then flow out of a peripheral area disposed between an outer surface of the bottle neck and a peripheral cap flange extending downwardly from the inner top wall of the cap.

2. The cap liner of claim 1, wherein:

the cap liner body is configured to withstand rupture when applied to an annular bottle lip having an outer diameter OD of from 15 mm to 120 mm at an application torque in a range of 5 to 75 inch-pounds (in-lbs) as provided according to Technical Bulletin SPI/PBI 20-1982.

3. The cap liner of claim 2, wherein:

the outer diameter OD and associated application torque range are selected from the group consisting of (OD; torque):

24 mm; 10 to 18 in-lbs;

28 mm; 12 to 20 in-lbs;

33 mm; 14 to 26 in-lbs;

38 mm; 16 to 28 in-lbs;

45 mm; 18 to 30 in-lbs; and 53 mm; 22 to 36 in-lbs.

4. The cap liner of claim 2, wherein:

the bottom layer has a thickness in a range of 0.0005 to 0.005 inch (12.5 to 125 micron);

the top layer has a thickness in a range of 0.020 to 0.100 inch (0.51 to 2.54 mm); and the outer diameter is in a range of 15 to 120 mm.

5. The cap liner of claim 4, wherein:

the surface area of the bottom surface of the disc-shaped liner is from 177 to 11,304 mm-squared (0.274 to 17.5 inch-squared).

6. The cap liner of claim 1, wherein:

the channels are substantially uniformly distributed across the top surface and extend partially or fully across the top surface.

7. The cap liner of claim 6, wherein:

the channels have a width in a range of 0.020 to 0.200 inch (0.51 to 5.1 mm) and a depth in a range of 0.0025 to 0.050 inch (0.064 to 1.27 mm).

8. The cap liner of claim 1, wherein:

the through-holes are substantially uniformly distributed across the grooved upper surface.

9. The cap liner of claim 1, wherein:

the through-holes are substantially cylindrical and have a diameter transverse to the thickness direction in a range of 0.4 to 1.4 mm.

10. The cap liner of claim 9, wherein:

the diameter of the through-holes is from 0.4-0.8 mm.

11. The cap liner of claim 10, wherein:

the diameter of the through-holes is from 0.5-0.6 mm.

12. The cap liner of claim 1, wherein:

the top layer includes a non-foam skin covering one or both of the upper and lower surfaces of the PO foam material, the non-foam skin being of a material that is the same or different than the PO foam material.

13. The cap liner of claim 1, wherein the MFP material comprises:

one or more polymers comprising polyethylene (PE) and polypropylene (PP), including copolymers and blends thereof, and one or more mineral fillers comprising a carbonate, oxide, silica, silicate, clay and sulfate.

14. The cap liner of claim 13, wherein:

the mineral fillers are one or more of CaCo3, TiO2, talc, kaolin, and CaSO4.

15. The cap liner of claim 13, wherein:

the one or more polymers comprise 30 to 70 percent of the total weight of the MFP material, the one or more mineral fillers comprise 30 to 70 percent of the total weight of the MFP material.

16. The cap liner of claim 1, wherein:

the PO foam material comprises polyethylene (PE).

17. The cap liner of claim 1, wherein the liner includes:

a further MFP material layer lies on the grooved upper surface of the PO foam layer and into the channels, to form the grooved upper surface of the top layer.

18. In combination, (a) a bottle having an annular bottle lip surrounding an open top end of a bottle neck;

(b) a removable closure cap having an inner top wall and a peripheral cap flange extending downwardly from the inner top wall that is secured to the bottle neck for enclosing the open top end; and (c) the cap liner body of claim 1 mounted on the cap and disposed between the annular bottle lip and the inner top wall of the cap, the cap liner body providing a liquid impervious seal that is resistant to rupture when a downwardly directed application torque is applied in a thickness direction of the liner body to compression seal the liner body between the annular bottle lip and the inner top wall of the cap.

19. A cap liner comprising:

a disc-shaped venting cap liner body having a bottom surface facing an annular bottle lip surrounding an open top end of a bottle neck, and a grooved top surface facing an inner top wall of a closure cap, the body being configured to provide a gas-permeable but liquid-impervious seal that is resistant to rupture when a downwardly directed application torque is applied in a thickness direction of the liner body to compression seal the liner body between the annular bottle lip and the inner top wall of the cap to form a sealed bottle, the cap liner body including top and bottom layers and a central layer between the top and bottom layers wherein:

(a) the bottom layer comprises a mineral-filler based polyolefin (MFP) material having a lower surface configured to compression seal to the annular bottle lip and an upper surface bonded to a non-grooved lower surface of the central layer, wherein the MFP material layer is substantially liquid-impervious while allowing release of gas evolving from a liquid product in the sealed bottle; and (b) the central layer comprises a compressible polymer material having a grooved upper surface with channels facing toward the inner top wall of the cap, and a plurality of through-holes extending in a thickness direction of the material between the grooved upper and non-grooved lower surfaces of the central layer;

(c) the top layer being configured to lie on the grooved upper surface of the central layer and into the channels facing the inner top wall of the cap, the top layer comprising a mineral-filler based polyolefin (MFP) material that is substantially liquid-impervious while allowing release of gas evolving from a liquid product in the sealed bottle, wherein the layers of the liner body allow gas, evolving from a product in the sealed bottle, to permeate out the open top end of the bottle neck, through the top and bottom layers of MFP material and the through-holes of the central layer, and along the channels facing the inner top wall of the cap, allowing the gas to then flow out of a peripheral area disposed between an outer surface of the bottle neck and a peripheral cap flange extending downwardly from the inner top wall of the cap.

20. The cap liner of claim 19, wherein the compressible polymer material of the central layer comprises one or more of a foam polymer material and a solid polymer material.

21. The cap liner of claim 19, wherein the compressible polymer material of the central layer comprises a foam polymer material comprising one or more of polyolefin and vinyl acetate polymer materials.

22. The cap liner of claim 21, wherein the polyolefin includes one or more of polyethylene and polypropylene.

23. The cap liner of claim 19, wherein the compressible polymer material of the central layer comprises a solid polymer material having a Shore A hardness in a range of 40 to 80 and comprising one or more thermoplastic elastomers and ethylene alpha-olefin resin polymers.

* * * * *